US009718171B2

(12) United States Patent
Huang

(10) Patent No.: US 9,718,171 B2
(45) Date of Patent: Aug. 1, 2017

(54) RAPID ADJUSTABLE WRENCH

(76) Inventor: Xudong Huang, Beijing (CN)

( * ) Notice: Subject to any disclaimer, the term of this patent is extended or adjusted under 35 U.S.C. 154(b) by 543 days.

(21) Appl. No.: 14/237,061

(22) PCT Filed: Jul. 25, 2012

(86) PCT No.: PCT/CN2012/079123

§ 371 (c)(1),
(2), (4) Date: Feb. 4, 2014

(87) PCT Pub. No.: WO2013/020453

PCT Pub. Date: Feb. 14, 2013

(65) Prior Publication Data

US 2014/0190318 A1 Jul. 10, 2014

(30) Foreign Application Priority Data

Aug. 5, 2011 (CN) ..... 2011 1 0223246

(51) Int. Cl.
*B25B 13/14* (2006.01)

(52) U.S. Cl.
CPC ..... *B25B 13/14* (2013.01)

(58) Field of Classification Search
CPC ..... B25B 13/00; B25B 13/14; B25B 13/18
(Continued)

(56) References Cited

U.S. PATENT DOCUMENTS 965,890 A * 8/1910 Geenwood ..... B25B 13/14 81/157
1,490,062 A * 4/1924 Nishimura ..... B25B 13/14 81/157
(Continued)

FOREIGN PATENT DOCUMENTS

CN 2066793 U 12/1990
CN 2071109 U 2/1991
(Continued)

OTHER PUBLICATIONS

International Search Report of corresponding International PCT Application No. PCT/CN2012/079123, dated Nov. 15, 2012.
(Continued)

*Primary Examiner* — Hadi Shakeri
(74) *Attorney, Agent, or Firm* — J.C. Patents

(57) ABSTRACT

The present invention relates to a rapid adjustable wrench, the wrench is provided with a worm rotation window on the lower side of the fixed wrench head, the support holes are provided on the both sides of the window, the support holes are the elongated aperture holes that enable the pin shift can radially moving up and down, the spring locating holes are provided on the lower side face of the elongated aperture holes respectively, the spring holds up the pin shaft to prompt the engagement of the teeth of the worm with the teeth of the adjustable wrench head; the length of the spring after the depress at least ensure that the length of the radial displacement of the worm teeth does not exceed the height of the adjustable wrench head teeth, the adjustable wrench head teeth have at least one tooth on the top end of the clamping face side, which height higher than that of the subsequent other teeth. The invention has a simple structure, convenient to use, holding the handle of the wrench with hands and pinching the worm with thumb and forefinger simultaneously to pull it down, such that it can quickly adjust the opening size of the clamping face, improving the using efficiency of the adjustable wrench; the settings for the different teeth height of the adjustable wrench head, in the case of the adjustable wrench head does not removed when achieve the adjustment of the opening size of the clamping face, reducing the processing operation to the adjustable wrench, saving the expense.

3 Claims, 7 Drawing Sheets

(58) Field of Classification Search
USPC ..... 81/157, 165
See application file for complete search history.

(56) References Cited

U.S. PATENT DOCUMENTS

| | | | | | |
|---|---|---|---|---|---|
| 2,499,644 | A | * | 3/1950 | Heyn | B25B 13/14 81/111 |
| 2,709,387 | A | * | 5/1955 | Brynge | B25B 13/14 81/157 |
| 3,803,954 | A | * | 4/1974 | Lenker | B25B 13/46 81/126 |
| 4,344,339 | A | * | 8/1982 | Penner | B25B 13/14 81/157 |
| 2006/0027052 | A1 | | 2/2006 | Rhodes | 81/156 |

FOREIGN PATENT DOCUMENTS

| | | | |
|---|---|---|---|
| CN | 2078673 | U | 6/1991 |
| CN | 2092406 | U | 1/1992 |
| CN | 2095068 | U | 2/1992 |
| CN | 202192574 | U | 4/2012 |

OTHER PUBLICATIONS

International Search Report of International Application No. PCT/CN20121/079123, dated Nov. 15, 2012.

* cited by examiner

RAPID ADJUSTABLE WRENCH

TECHNICAL FIELD

The present invention is in the field of hardware tools, and more particularly relates to a rapid adjustable wrench with a fast adjustment function, when the workpiece is clamped by the adjustable wrench, holding the handle of the wrench with hands and pinching the worm with thumb and forefinger simultaneously to pull it down, the adjustable wrench head will quickly slide, thereby greatly improving the efficiency.

BACKGROUND ART

The adjustable wrench is one of the most commonly used hand tools in the hardware tools, the advantage of the ordinary adjustable wrench is that it can rotate the hexagonal workpiece with a variety of specifications and dimensions simultaneously, its disadvantage is that when rotating the workpiece with a larger difference in specification, it requires long time to rotate the worm to adjust the opening size of the clamping face, the work efficiency is low and inconvenient in use.

SUMMARY OF THE INVENTION

To overcome the deficiency of the ordinary adjustable wrench, the present invention provides a rapid adjustable wrench, the adjustable wrench not only retains all the functions of the ordinary adjustable wrench, but also provides the function that enable the clamping face can rapidly opening and closing, when the workpiece is clamped by the rapid adjustable wrench, holding the handle of the wrench with hands and pinching the worm with thumb and forefinger simultaneously to pull it down, the adjustable wrench head will rapidly slide toward a direction that away from the fixed wrench head, loosening the worm and pushing the adjustable wrench head lightly, such that the adjustable wrench head can rapidly slide toward the fixed wrench head direction, upon contact with the workpiece, rotating the worm slightly, the workpiece will be rapidly locked, thereby greatly improving the efficiency.

In order to achieve the above purpose, the technical solutions of the present invention are:

A rapid adjustable wrench, the adjustable wrench is comprised of wrench body, adjustable wrench head, worm, pin shaft, spring, support pin, bond type wedge, stop pin, there is a fixed wrench head in the front end of the wrench body, there is a handle in the back end of the wrench body, there is a clamping face on the fixed wrench head, there is a recess below the fixed wrench head, there are two faces that parallel to each other in the inner upper of the recess, the lower of the recess is in a circular arc surface, there is a cutout downward the middle portion of the circular arc surface, the cutout connects with a rectangular through hole, the adjustable wrench head is comprised of the upper portion, middle portion and lower portion, there is a clamping face on the upper portion, the thickness of the middle portion is less than the distance of the two faces that are parallel to each other within the recess of the fixed wrench head, the two sides of the lower portion of the adjustable wrench head are symmetrical and in circular arc surface, the greatest distance between the arc face is less than the diameter of the bottom circular arc surface of the recess of the fixed wrench head, the teeth are set on the top end of the lower portion of the adjustable wrench head, the top of the teeth is in blunt and meshed with the spiral gear of the worm, wherein, a bond type hole is set below the recess of the fixed wrench head, the bond type hole through the rectangular through hole from the wrench body surface that away from the clamping face of the fixed wrench head and extends to a position that adjacent to the below of the clamping face of the fixed wrench head, and forms a bond type through hole and a bond type blind hole, which are located on the two sides of the rectangular through hole respectively, the centerline of the bone type hole is perpendicular to the clamping face of the fixed wrench head, two spring holes through the lower portion of the recess, and extend to the lower portion of another side of the bond type through hole and the bond type blind hole respectively, inserting the one end of the spring into the spring hole through the lower portion of the recess, inserting the thinner end of the two support pins into the central hole of the spring also through the lower portion of the recess, putting the worm into the middle of the rectangular through hole, inserting the one end of the pin shaft into the bond type through hole from the outside of the wrench body, while depressing the top end of the support pin within the bond type through hole, such that the pin shaft is located over the top end of the support pin, the pin shaft through the central hole of the worm, while depressing the top end of the support pin within the bond type blind hole until the pin shaft is located over the top end of the support pin, and contacted with the bottom face of the bond type blind hole, thereafter, embedding the bond type wedge into the bond type hole from the outside of the wrench body, and preventing the pin shaft removed from the wrench body, depressing the worm in the opposite direction of the spring tension, facing the clamping face of the adjustable wrench head with the clamping face of the fixed wrench head and pushing the lower portion of the adjustable wrench head to the recess of the fixed wrench head, a recess is set on one side of the middle portion of the adjustable wrench head which is mated with the adjustable wrench head, a stop through hole is set on one side of the recess that away from the clamping face of the fixed wrench head, fixing the stop pin within the stop through hole, and preventing the adjustable wrench head from sliding off along a direction that away from the clamping face of the fixed wrench head.

The extension lines of the spiral teeth of the worm intersect at an acute angle, the top end of the acute angle is in planar and knurled.

The length of the spring is less than the depth of the spring hole that away from one side of the recess.

The support pin is in cylindrical, and one end of which is in arc-shaped concave.

A rapid adjustable wrench, includes a fixed wrench head integrated with the handle of the wrench, and a adjustable wrench head driven by the rotation of the worm, the teeth are set on the adjustable wrench head, which can mesh with the spiral teeth of the worm, the wrench is provided with a through window on the lower side of the fixed wrench head, the support holes are set on the side wall of the two horizontal sides of the through window, the pin shaft which set in the support hole supports the worm in the through window; characterized in that, the aperture of the support hole in both sides of the through window is a elongated aperture that enable the pin shaft can radially moving up and down, the spring locating hole is set on the lower side face of the support hole in the two horizontal sides of the through window respectively, spring is set in the spring locating hole, the spring holds up the pin shaft to prompt the engagement of the teeth of the worm with the teeth of the adjustable wrench head; the adjustable wrench head teeth have at least one tooth on the top end of the clamping face, which height is higher than that of the subsequent other teeth, the length of the spring after the depress at least ensure that the length of the radial displacement of the worm teeth does not exceed the height of the highest teeth of the adjustable wrench head.

The length of the spring that is depressed is to ensure that the length of the radial displacement of the worm teeth is one-half to four-fifths of the height of the highest teeth of the adjustable wrench head.

The adjustable wrench head teeth have two teeth on the top end of the clamping face, which height is higher than that of the subsequent other teeth, the height of the other teeth is the same, the height of the other teeth is four-fifths of the height of the two teeth in the top end.

The cylindrical support pin is set on the spring, the spring pushes the cylindrical support pin, such that the cylindrical support pin is against on the pin shaft.

The invention has a simple structure, convenient to use, pinching the worm with thumb and forefinger simultaneously to pull it down, such that it can quickly adjust the opening size of the clamping face, improving the using efficiency of the adjustable wrench; the settings for the different teeth height of the adjustable wrench head, in the case of the adjustable wrench head does not removed when achieve the adjustment of the opening size of the clamping face, reducing the processing operation to the adjustable wrench, saving the expense.

The present invention will next be described in detail with reference to the drawings and embodiments.

DETAILED DESCRIPTION OF THE INVENTION

Embodiment 1

Figure 1:
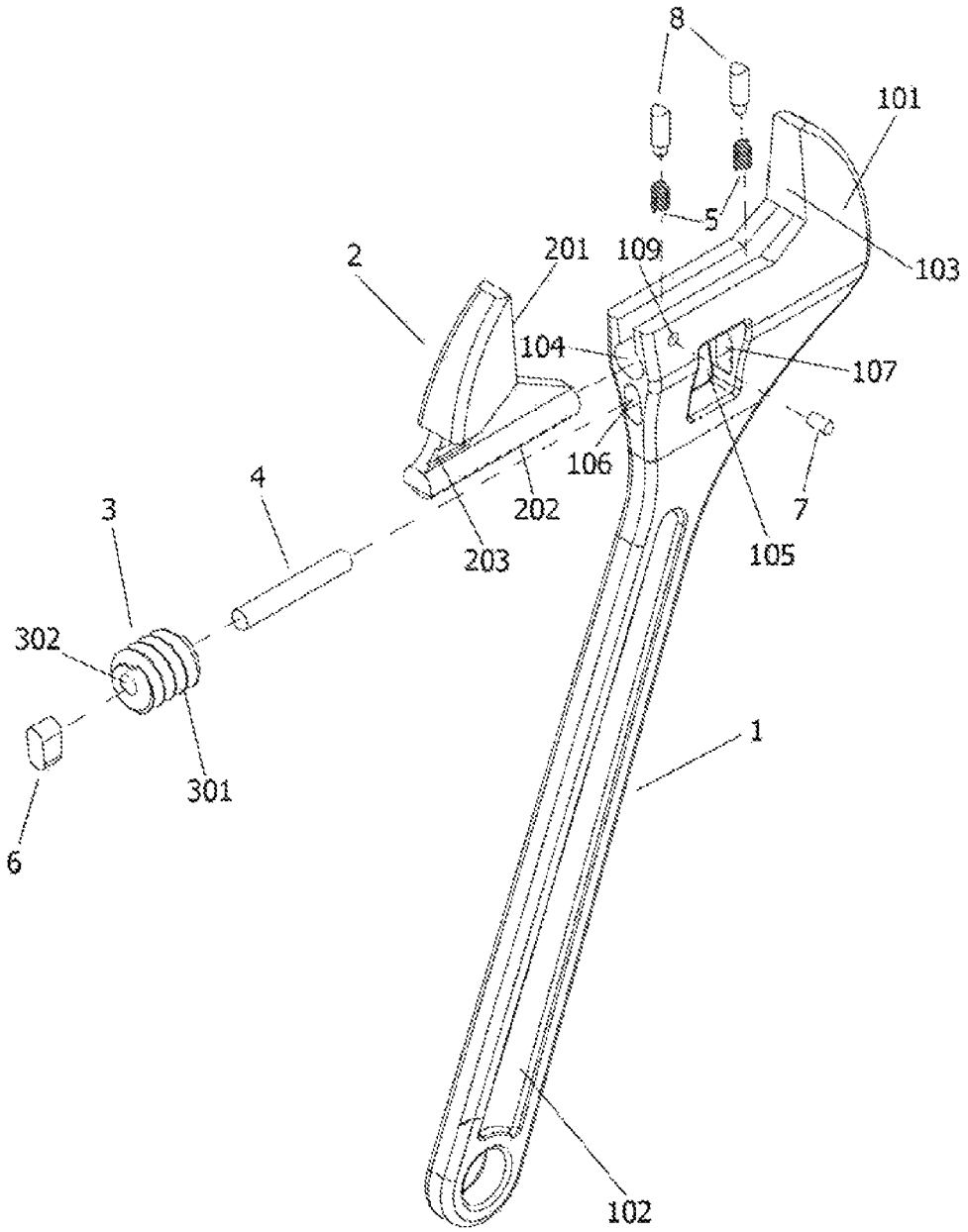
FIG. 1 is an exploded view showing the structure of the present invention.
Figure 2:
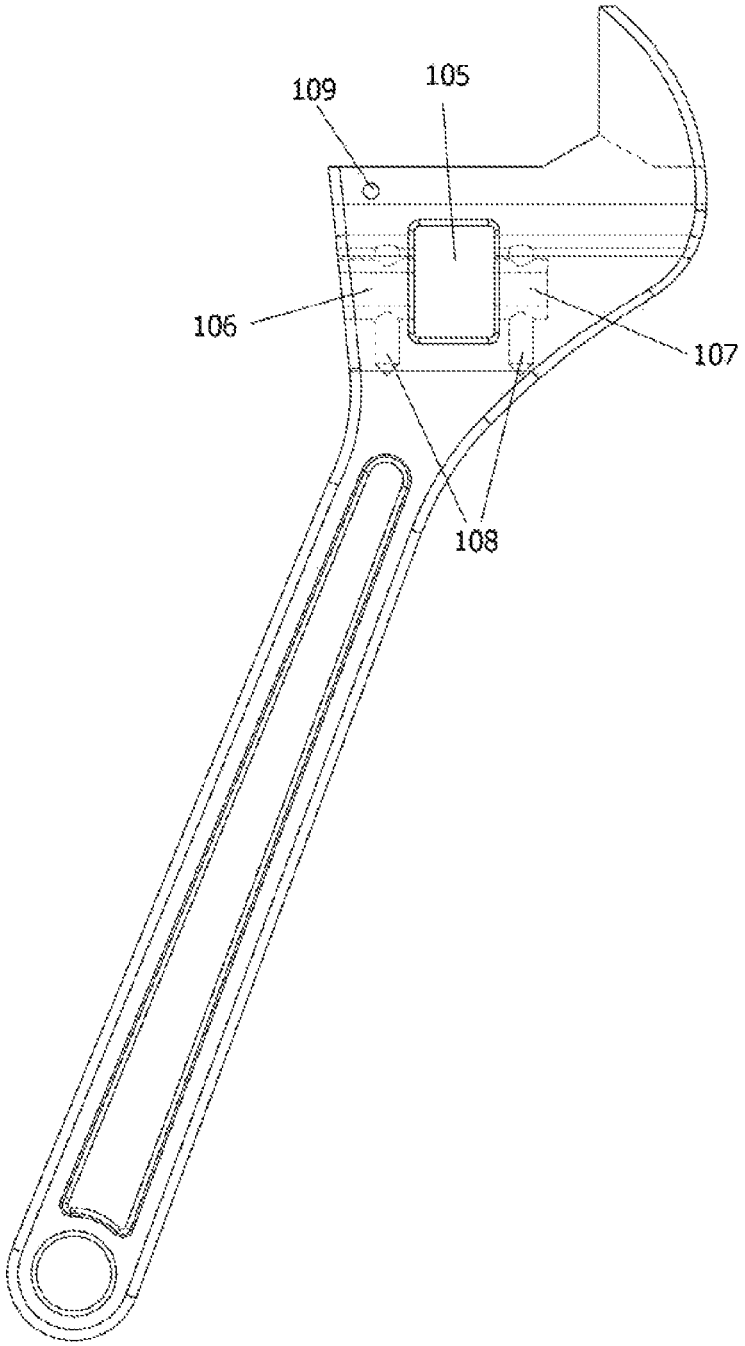
FIG. 2 is a front perspective view showing the wrench body structure of the present invention.
Figure 3:
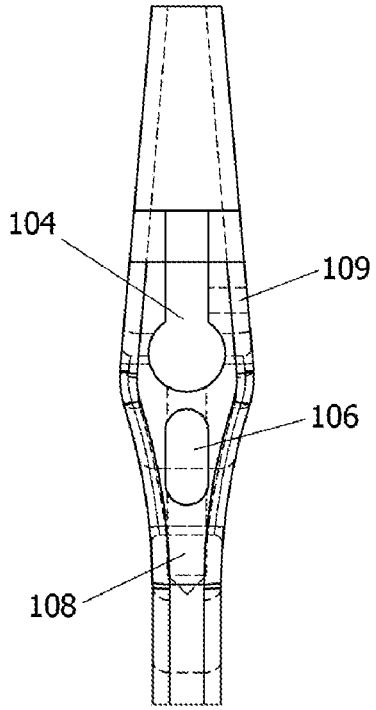
FIG. 3 is a left perspective view of a portion of the fixed wrench head of the wrench body structure of the present invention.
Figure 4:
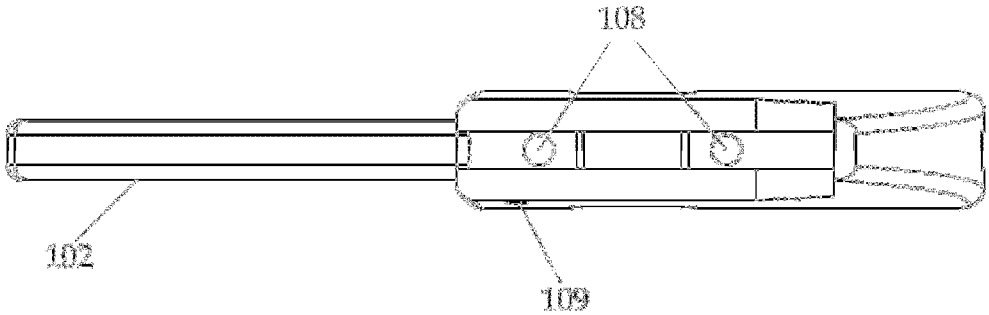
FIG. 4 is a top view showing the wrench body structure of the present invention.
Figure 5:
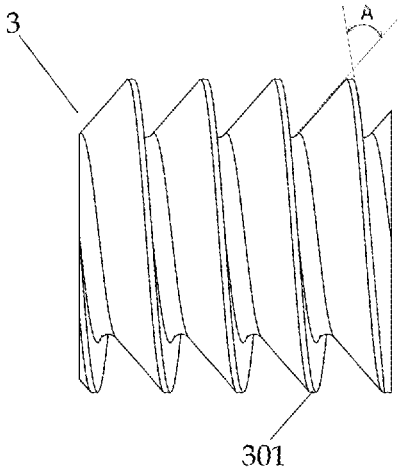
FIG. 5 is a front perspective view of the worm of the present invention.
Figure 6:
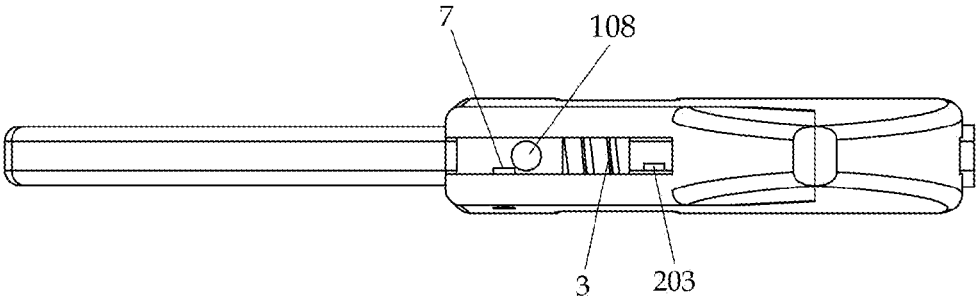
FIG. 6 is a top view of the assembled device of the present invention.
Figure 7:
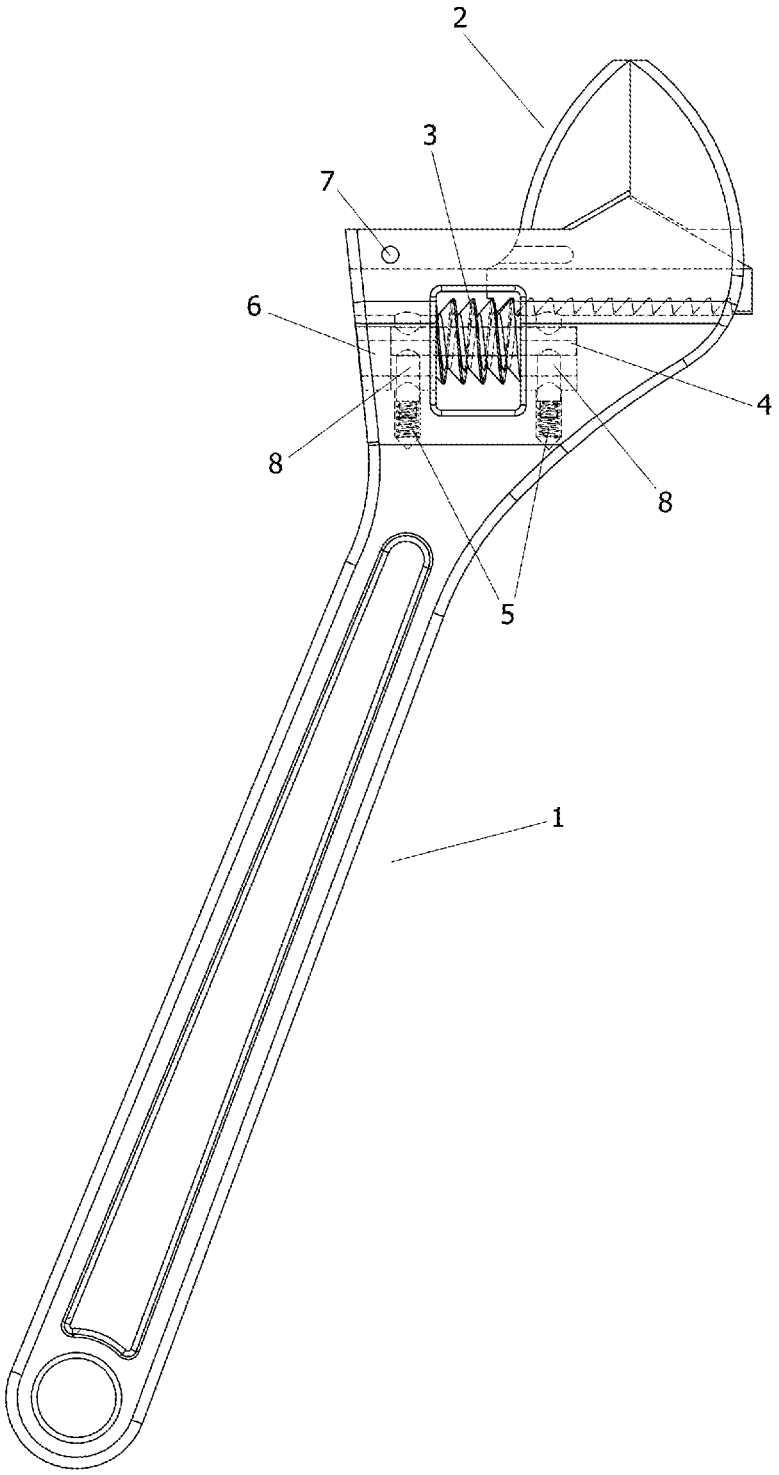
FIG. 7 is a front perspective view of the assembled device of the present invention.

A adjustable wrench embodiment, referring to FIGS. 1 to 7, as shown in FIG. 1, the wrench is comprised of wrench body 1, adjustable wrench head 2, worm 3, pin shaft 4, spring 5, bond type wedge 6, stop pin 7, support pin 8, the front end of the wrench body 1 is a fixed wrench head 101, the back end of the wrench body is a handle 102, there is a workpiece clamping face 103 on the fixed wrench body, there is a workpiece clamping face 201 on the adjustable wrench head 2, as shown in FIG. 1, FIG. 2, FIG. 3, FIG. 4, 104 is the recess of the fixed wrench head, 105 is the rectangular through hole, 106 is the bond type through hole, 107 is the bond type blind hole, 108 is the spring hole, 109 is the stop hole, as shown in FIG. 1, FIG. 6, FIG. 7, inserting one end of the spring 5 into the spring hole 108 respectively, placing the worm 3 in the middle of the rectangular through hole 105, inserting the pin shaft 4 into the bond type through hole 106 from the outside of the wrench body, while depressing the top end of the support pin 8 within the bond type through hole, such that the pin shaft is located over the arc-shaped concave of the top end of the support pin, the pin shaft through the center hole 302 of the worm, and depressing the top end of the support pin 8 within the bond type blind hole, until the pin shaft is located over the arc-shaped concave of the top end of the support pin, and contacted with the bottom face of the bond type blind hole 107, thereafter, embedding the bond type wedge 6 into the bond type hole from the outside of the wrench body, and preventing the pin shaft removed from the wrench body, depressing the worm 3 in the opposite direction of the spring tension, facing the clamping face 201 of the adjustable wrench head with the clamping face 103 of the fixed wrench head and inserting it into the recess 104 of the fixed wrench head, a recess 203 is set on one side of the middle portion of the adjustable wrench head, which is mated with the adjustable wrench head, a stop hole 109 is set on one side of the recess 104 that away from the clamping face 103 of the fixed wrench head, fixing the stop pin 7 within the stop hole, and preventing the adjustable wrench head from slipping off along a direction that away from the clamping face of the fixed wrench head, as shown in FIG. 5, the extension lines of the teeth face of the teeth 301 of the worm intersect at an acute angle A (an acute angle of 30 degree to 45 degree), the present embodiment is an acute angle of 35 degree, the top end of the teeth of the worm is in a arc surface and meshed with the teeth 202 of the top end of the lower portion of the adjustable wrench head 2, when the adjustable wrench head 2 away from the fixed wrench head, holding the handle 102 with the hands and pushing the fixed wrench head with the thumb, such that it can quickly achieve the rapid movement of the clamping face of the adjustable wrench head toward the clamping face of the fixed wrench head, pulling the worm 3 with the thumb and forefinger, such that the worm teeth is fully disengagement and meshed with the teeth which located on the top end of the lower portion of the adjustable wrench head, at this time, the adjustable wrench head can freely move back and forth within the recess.

Embodiment 2

This embodiment is an improvement on the basis of the embodiment 1, please refer to the content disclosed in embodiment 1 to understood the parts similar to the embodiment 1 in this embodiment.

Figure 8:
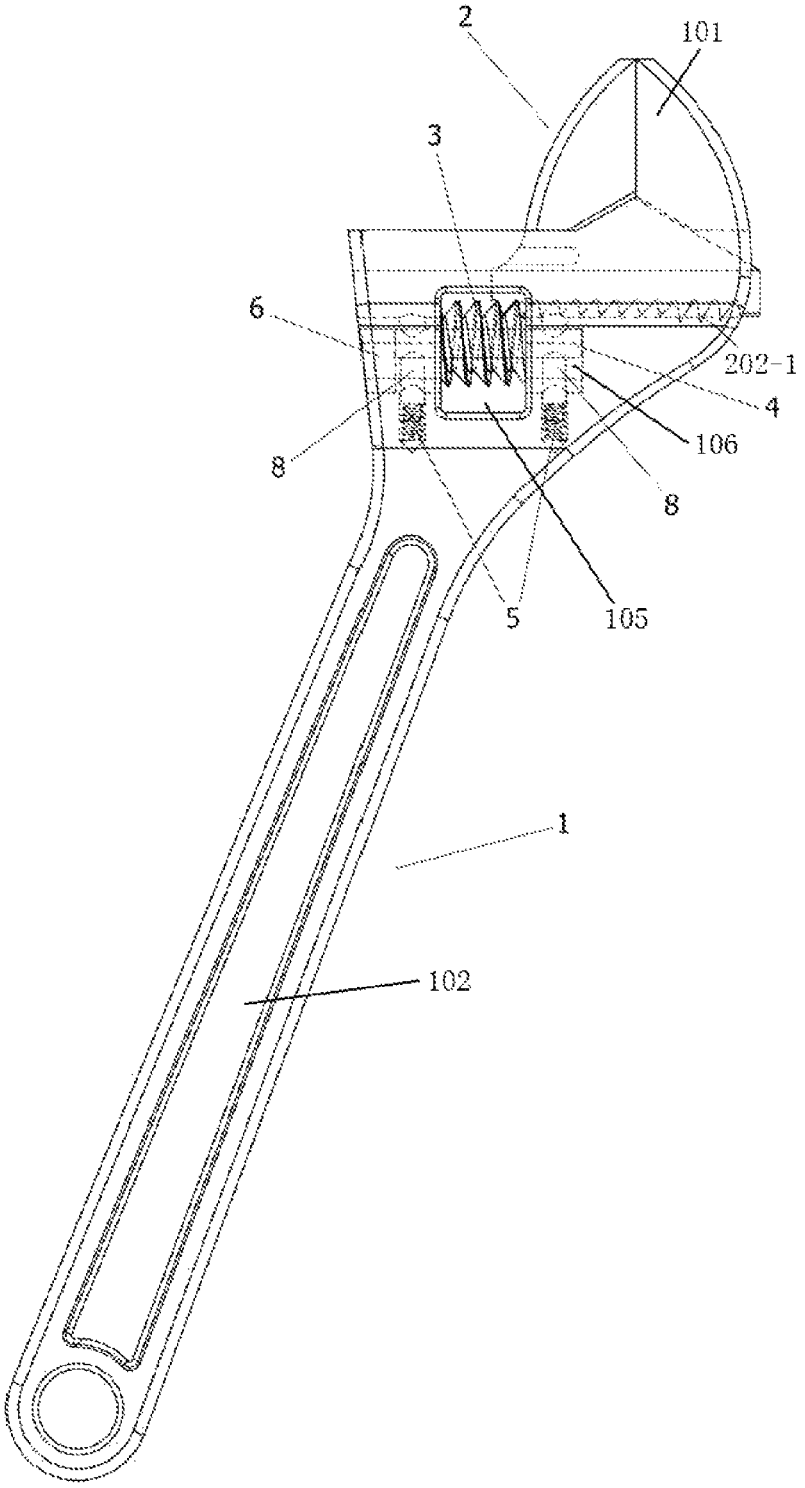
FIG. 8 is a schematic diagram showing the wrench body structure of the embodiment 2 of the present invention.
Figure 9:
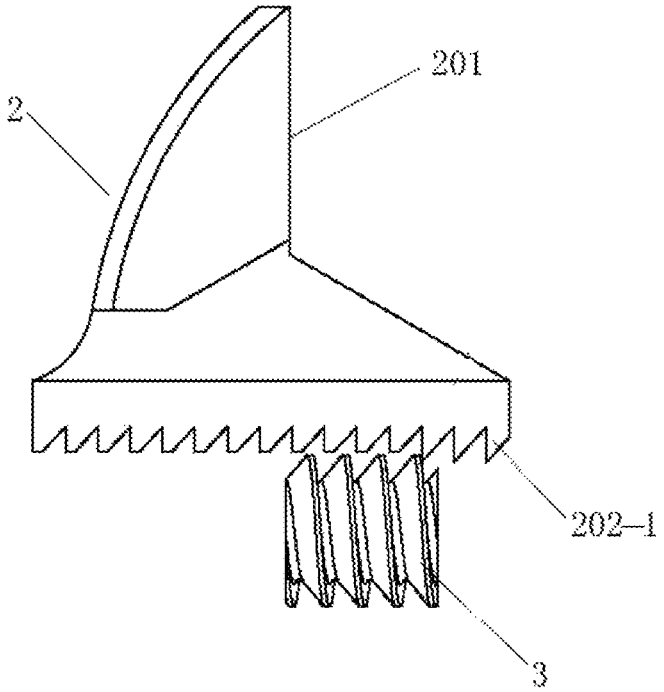
FIG. 9 is a schematic diagram showing the engagement structure of the worm with the adjustable wrench teeth of the present invention.

Referring to FIG. 8 and FIG. 9, a rapid adjustable wrench, includes a fixed wrench head 101 integrated with the handle 102 of the wrench 1, and a adjustable wrench head 2 driven by the rotation of the worm 3, the teeth 202 are set on the adjustable wrench head, which can mesh with the spiral teeth of the worm, the wrench is set with a through window 105 (rectangular through hole in embodiment 1) on the underside of the fixed wrench head, the support holes 106 and 107 are set on the side wall of the two horizontal sides of the through window, the pin shaft 4 which set in the support hole supports the worm in the through window; wherein, the aperture of the support hole in both sides of the through window is a elongated aperture (the bond type hole in embodiment 1) that enable the pin shaft can radially moving up and down, the spring locating holes (spring hole) 108 are set on the underside face of the support hole in the two horizontal sides of the through window, spring 5 is set in the spring locating hole, the spring holds up the pin shaft to prompt the engagement of the teeth of the worm with the teeth of the adjustable wrench head, the differences from embodiment 1 in that, the teeth 202-1 of the adjustable wrench head teeth have at least one tooth on the top side of the clamping face side, which height is higher than that of the subsequent other teeth, the length of the spring after the depress at least ensure that the radial displacement length of the worm teeth does not exceed the height of the highest teeth of the adjustable wrench.

In embodiments, a cylindrical support pin 8 is set on the spring, the spring pushes the cylindrical support pin, such that the support pin is against on the pin shaft.

Embodiment 3

This embodiment is an improvement on the basis of the embodiment 2, please refer to the content disclosed in embodiment 2 to understood the parts similar to the embodiment 2 in this embodiment, the content disclosed in embodiment 2 should also be as the content of the present embodiment, the repetitive description is not made herein.

In embodiments, the depressed length of the spring is to ensure that the length of the radial displacement of the worm teeth is one-half to four-fifths of the height of the highest teeth of the adjustable wrench head.

In order to increase the reliability, in this embodiment, the adjustable wrench head teeth have three teeth on the top end of the clamping face, which height is higher than that of the subsequent other teeth, the height of the other teeth is the same, the height of the other teeth is four-fifths of the height of three teeth on the top end. The method is to leave the three teeth of the adjustable wrench head teeth not moving, which on the top end of the clamping face side, the remaining teeth for blunt processing.

In this embodiment, holding the wrench with hands, pinching the worm with thumb and forefinger simultaneously to pull it down, at this time, the spring is compressed, such that the spiral gear crest of the worm completely removed and meshed with the teeth which located on the blunt portion of the top end of the lower portion of the adjustable wrench head, the adjustable wrench head can slide freely within the horizontal direction (transverse) of the through window of the fixed wrench head, loosening the worm, since the design of the spiral teeth angle is reasonable, under the spring tension, the spiral gear will automatically mesh with the teeth which located on the top end of the lower portion of the adjustable wrench head, when the adjustable wrench head away from the clamping face of the fixed wrench head, pushes the wrench head lightly toward a direction that close to the clamping face of the fixed wrench head, at this time, the spring is automatically compressed down, without rotating the worm, the adjustable wrench head will quickly moving toward the clamping face direction of the fixed wrench head, when the rotation of the workpiece is required, after the clamping face of the fixed wrench head and the clamping face of the adjustable wrench head contact with the workpiece, rotating the worm slightly with the thumb and forefinger to trim, the two clamping faces will quickly locked the workpiece surface, thereby achieve the purposes that can quickly adjust the opening and closing of the clamping face, while due to the three teeth in the top end of the adjustable wrench head higher than the other teeth, so the adjustable wrench head will not be removed from the wrench body due to the block of the higher teeth when pinching the worm with thumb and forefinger simultaneously to pull it down.

The invention claimed is:

1. A rapid adjustable wrench, including a fixed wrench head integrated with a handle of the wrench, an adjustable wrench head driven by the rotation of a worm, wherein a first set of teeth of the same height and a second set of teeth of the same height are formed on the adjustable wrench head, spiral teeth are formed on the worm, and the first set of teeth and the second set of teeth of the adjustable wrench head are to be meshed with the spiral teeth of the worm, respectively, the wrench is provided with a through window on a lower side of the fixed wrench head, support holes are set on a side wall of two horizontal sides of the through window, a pin shaft set in the support holes supports the worm in the through window;

wherein an aperture of each of the support holes in both the two horizontal sides of the through window is an elongated aperture that enables the pin shaft to radially move up and down, spring locating holes are set on a lower side face of the support holes in the two horizontal sides of the through window respectively, a spring is set in each of the spring locating holes, the spring holds up the pin shaft to prompt the engagement of the teeth of the worm with the first set of teeth of the adjustable wrench head; the first set of teeth and the second set of teeth are formed on a same plane of the adjustable wrench head with the second set of teeth of the adjustable wrench head being positioned at a top end of a clamping face, the height of the second set of teeth is higher than that of the first set of teeth of the adjustable wrench head, the elongated aperture of each of the support holes is so sized to ensure that the length of a radial displacement of the worm teeth is one-half to four-fifths of the height of the second set of teeth of the adjustable wrench head, so that when the worm is pushed to a upmost position by the spring, the first set of teeth are meshed with the spiral teeth of the worm, and when the worm is pulled back to a lowest position by a user, the second set of teeth are meshed with the spiral teeth of the worm while the first set of teeth are disengaged with the spiral teeth of the worm.

2. The rapid adjustable wrench head of claim 1, wherein the second set of teeth of the adjustable wrench head include two teeth the height of the first set of teeth of the adjustable wrench is four-fifths of the height of the second set of teeth.

3. The rapid adjustable wrench head of claim 1, wherein a support pin is set on the spring, the spring pushes the support pin, such that the support pin is against on the pin shaft, the spring locating holes are substantially perpendicular to the lower side face of the support holes, the support pin is set in each of the spring locating holes and has an arc-shaped concave end for receiving the pin shaft.

* * * * *